US005412848A

United States Patent [19]

Precourt, Jr.

[11] Patent Number: 5,412,848

[45] Date of Patent: May 9, 1995

[54] CLIP MECHANISM HAVING OUTWARDLY BIASED LEG MEMBERS

[75] Inventor: Ronald E. Precourt, Jr., Woonsocket, R.I.

[73] Assignee: Leach & Garner Company, North Attleboro, Mass.

[21] Appl. No.: 9,849

[22] Filed: Jan. 27, 1993

[51] Int. Cl.[6] ..... A44B 1/38; F16B 13/04

[52] U.S. Cl. ..... 24/99; 24/662; 411/342; 411/913

[58] Field of Search ..... 24/662, 94, 99; 411/341, 342, 508, 509, 510, 913

[56] References Cited

U.S. PATENT DOCUMENTS

| | | | |
|---|---|---|---|
| 407,643 | 7/1889 | Dittmann | 24/99 |
| 578,294 | 3/1897 | Leavitt | 24/99 |
| 1,360,200 | 11/1920 | Dowd | 411/342 |
| 1,621,570 | 3/1927 | Williams | 24/99 |

FOREIGN PATENT DOCUMENTS

| | | | |
|---|---|---|---|
| 27443 | 6/1884 | Germany | 24/99 |
| 69517 | 7/1893 | Germany | 24/99 |

OTHER PUBLICATIONS

Paper Clip, U.S. Patent & Trademark Office Supply; date unknown.

*Primary Examiner*—Richard A. Bertsch
*Assistant Examiner*—Roland G. McAndrews, Jr.
*Attorney, Agent, or Firm*—Phillips, Lytle, Hitchcock, Blaine & Huber

[57] ABSTRACT

This invention most generally relates to a clip mechanism assembleable to the back-side of an ornament member, most preferably jewelry objects or fanciful buttons and the like, to be displayed by removable attachment to clothing mainly through "button-holes" and used, for example, as tuxedo-studs, cuff-links, lapel-pins, etc. The clip mechanism may also be used with hooks or posts upon which may be placed, or hung, tools, pictures, or articles for display. The clip mechanism is removably insertable into a mounting hole or peg-board hole and because of the particular design of the clip mechanism will support the article hung on the hook or post. The clip mechanism is removable with a pulling force in a direction opposite the direction of insertion of the mechanism. More particularly the clip mechanism comprises, preferably, a pair of wire springs, each of which exerts an outward force, and a yoke with integrated internal cams, which cause an inward motion of at least one leg and foot portion of each of the spring members. In the "pinched" or stressed position, herein also referred to as the closed or inserting or vertical position, the springs are nearly parallel to each other. In the relaxed position, herein also referred to as the normal or closed or horizontal position, the springs assume a horizontal and opposing position thereby locking through a garment's material.

11 Claims, 4 Drawing Sheets

CLIP MECHANISM HAVING OUTWARDLY BIASED LEG MEMBERS

BACKGROUND OF THE INVENTION

1. Field of the Invention

This invention most generally relates to a clip mechanism assembleable to the back-side of an ornament member, most preferably jewelry objects or fanciful buttons and the like, to be displayed by removable attachment to clothing mainly through "button-holes" and used, for example, as tuxedo-studs, cuff-links, lapel-pins, etc. The mechanism may be used for attaching together of a plurality of paper or fabric pieces. The clip mechanism may also be used with hooks or posts upon which may be placed, or hung, tools, pictures, or articles for display. The clip mechanism is removably insertable into a mounting hole or peg-board hole and because of the particular design of the clip mechanism will support the article hung on the hook or post. The clip mechanism is removable with a pulling force in a direction opposite the direction of insertion of the mechanism. It is of particular interest that the clip mechanism is removably attachable to a surface through holes not having convenient access to the back-side thereof, i.e., the side opposing the side through which wires or springs of the clip mechanism is inserted.

The clip mechanism comprises , preferably, a pair of wire springs, each of which has energy stored therein which creates a force tending to orient each of the springs of the pair in a horizontal and opposed orientation relative to each other, and a yoke member with integrated internal cams into which the pair of springs is assembled and which, when the spring is rotated from the horizontal toward a vertical position, causes a motion of at least one leg and foot portion of the spring members which motion causes the stored spring energy to be created within the spring.

In the "pinched" or stressed position, herein also referred to as the closed or inserting or vertical position, the springs are nearly parallel to each other and "facing" each other. In the relaxed position, herein also referred to as the normal or closed or horizontal position, the springs assume a horizontal and opposing position thereby locking through a garment's material.

2. Description of the Prior Art

Presently there is nothing available that permits the attachment of jewelry to clothing in the manner and ease provided with the present clip mechanism. Particularly, the mechanism works to effectively attach, for example, a stud to a shirt or cuff links to the sleeve without having to access the back side of the material through which the clip is inserted. Likewise, removal can be achieved with a pulling motion and, again, without access to the back of the material. The cams of the yoke can be so configured so that the jewelry article does not easily release. A clear pull on the article must be present in order for the springs to be squeezed to the extent necessary to allow them to rotate to the extent necessary to be substantially adjacent from the opposing position when the article is attached i.e., the springs in the unstressed position.

The following U.S. patents have been reviewed relative to the invention disclosed and claimed herein.

U.S. patents to Simon, Spaulding, Murphy and Kent disclose fastening for shirt studs, a shirt and stud button, a collar button and safety studs.

Simon H., U.S. Pat. No. 23,617 teaches in FIG. 1 the pinching of the members so that they may be inserted into the clothing. FIGS. 2 and 3 are sections each of which shows the device secured onto the article of clothing. Simon notes in col. 1, lines 20–34, that ". . . pressure exerted on the outer ends of the arms tends to lock them more firmly while they can easily be unlocked by a slight strain, whereby the central pin is removed from the pivot which fastens the arms to the stud." The device of Simon is relatively complicated as to the mechanism and the manner in which it works. In the mechanism of the present invention, removal can be achieved with a pulling motion and without access to the back of the material. The cams of the yoke can be so configured so that the jewelry article does not easily release. A clear pull on the article must be present in order for the springs to be squeezed to the extent necessary to allow them to rotate to be substantially adjacent from the opposing position when the article is attached i.e., the springs in the unstressed position. The features and advantages of the present invention are not possible with the Simon device or other prior art devices which have been reviewed.

Spaulding, U.S. Pat. No. 213,787 teaches a disk or button having two curved arms hinged to the button at the middle. They turn on one common hinge pin and one of the arms extends through the other arm. The geometry of the arms is such that when the arms are passed through the hole of the material ". . . will gradually be moved into the position shown in FIGS. 1 and 2. On the inner arm B, passing by the bends cc of the slitted or duplex arm C, the latter will spring out or give way, and after the inner are, B, may have passed the bends the inherent elasticity of the metal composing the said slitted arm will cause the bends to approach each other and operate as means of keeping the two arms in position in a manner to prevent accidental displacement of the stud or loss of it . . . . On pulling the stud forward it may be drawn out of the hole." The duplex or slotted arm of the Spaulding device is provided with spring-bends to receive and guide the plain or curved arm further preventing lateral bending and breaking.

Murphy, U.S. Pat. No. 775,607 teaches a collar-button with a novel "V" spring and bell-crank lever arrangement which operates by virtue of the geometric relationship between the ends of the levers and the rotation about a pin. In the mechanism of Murphy there is needed a separate spring device.

Kent, U.S. Pat. No. 136,166 teaches safety-studs having a spiral spring, movable piston, hinged arms and a hollow cylindrical stem.

Adams, U.S. Pat. No. 420,650 relates somewhat to Spaulding in that one arm fits within a second arm when the device is configured to be inserted into a hole.

Smith, U.S. Pat. No. 885,879 teaches prongs but the head of this button has a front-plate and a back-plate one of which is made of spring metal.

The U.S. Pat. Nos.: 1,348,985 to Evens, B. R.; 990,056 to Lockhart, D.C.; and 739,185 to Kearney, J. were also reviewed.

The present invention as disclosed and claimed herein has clear and unobvious advantages over all of the prior art known to the Applicant.

SUMMARY OF THE INVENTION

The present invention in it's most simple form or embodiment is directed to a clip mechanism assembleable to the back-side of an ornament member, most preferably jewelry objects or fanciful buttons and the like, to be displayed by removable attachment to clothing mainly through "button-holes" and used, for example, as tuxedo-studs, cuff-links, lapel-pins, etc. Particularly, the invention disclosed herein is very simply based upon a caused motion of at least one leg and foot portion of at least one spring member which motion causes stored spring energy to be created within at least one spring. More particularly, the clip mechanism comprises, preferably, a pair of wire springs, each of which has energy stored therein which creates a force tending to orient each of the springs of the pair in a horizontal and opposed orientation relative to each other, and a yoke member with integrated internal cams into which the pair of springs is assembled and which, when the spring is rotated from the horizontal toward a vertical position, causes a motion of at least one leg and foot portion of the spring members which motion causes the stored spring energy to be created within the spring.

Even more particularly, the clip mechanism comprises, preferably, a pair of wire springs, each of which has energy stored therein which creates a force tending to orient each of the springs of the pair in a horizontal and opposed orientation relative to each other, and a yoke member with integrated internal cams into which the pair of springs is assembled and which, when the spring is rotated from the horizontal toward a vertical position, causes a motion of at least one leg and foot portion of the spring members which motion causes the stored spring energy to be created within the spring. The clip mechanism of the instant invention can be engaged and disengaged having access to only the insertion side of the hole into which the mechanism is mounted.

A primary object of the invention is to provide a clip mechanism comprising a yoke member, at least two spring members fabricated using material which is resilient but form retaining. Each of the spring members comprises, a crotch portion at a crotch end contiguous with at least one leg portion, which leg portion is contiguous with at least one foot portion at a foot end. The foot end generally refers to the end of the spring member opposite the crotch end. The leg portion generally refers to the part of the spring member between the crotch end and the foot end. The foot end is adapted to be interengageable with a head portion at a head end of the yoke member and interengaged therewith. The crotch portion, leg portion and foot portion each having a predetermined cross section. There is also an interengaging means within the head portion at the head end. The interengaging means is and adapted to provide interengagement with each of the at least one foot portion at the foot end of each of the at least two spring members to interengage the yoke and the at least two spring members. There is a means permitting rotation, upon pinching of each of the at least two spring members, from a normal and secure horizontal opposed orientation to a stressed and vertical orientation. The means for permitting rotation is incorporated into the head portion of the yoke member. Additionally there is a means for creating restoration forces within each of the at least two spring members when each spring member is rotated from a normal and secure horizontal opposed orientation to a stressed and vertical orientation. The means for creating restoration forces is incorporated into the head portion of the yoke member. Finally, the yoke member further comprises a trunk portion having a base end, the trunk portion contiguous with and between the head portion at the head end and the base end.

Another primary object of the present invention is to provide the clip mechanism having only one leg portion as above described wherein the predetermined cross section of the leg portion is substantially similar to a strip like member or ribbon having curved, rounded ends forming a ribbon spring member. A ribbon spring member is characterized by being springingly bendable through the leg portion along a direction from the foot end toward the crotch end. The forces are created consequentially by the rotation of each of the at least two ribbon spring members and by the resilience of the material. The ribbon spring member is predisposed to bend in a direction generally perpendicular to the forces applied to the ribbon spring member from their rotation. The at least two spring members may alternatively have a leg portion wherein the predetermined cross section is each substantially similar to that of two spaces substantially parallel spaced rods or wires. Thus, each leg is rod or wire shaped (e.g. 22A and 22B) which wire spring member is characterized by being springingly bendable substantially through the crotch portion. The forces created as above noted.

Yet another primary object of the present invention is to provide the clip mechanism as described above wherein the interengaging means comprises the head portion of the yoke member having therein at least two pairs of foot holes each pair adapted to receive therein the foot portions of each of the two spring members and oriented to create an axis for the rotation for each of the at least two spring members.

A particular object of the present invention is to provide the clip mechanism as described above wherein the means permitting rotation of each of the at least two spring members and the means for creating restoration forces within each of the at least two spring members, comprises the head portion of the yoke member having therein at least two spring member apertures. Each of the apertures has a periphery defined by a short side a long side and a first and second opposed sides. The short and long sides being parallel each to the other and parallel to the axis of rotation of the spring members. The short and long side being oriented on the head portion and spaced apart by an amount permitting the rotation of each of the at least two spring members. The short side is proximate the head end and the long side proximate the trunk portion of the yoke member. The first and second opposed and non-parallel sides provide a bearing surface against which an ankle portion of the foot portion of the spring member rests thereby creating restoration forces within each of the at least two spring members when each of the spring members is rotated from a normal and secure horizontal opposed orientation to a stressed and vertical orientation.

A more particular object of the present invention is to provide the clip mechanism as described above wherein the periphery of each of the two spring member apertures is substantially that of a trapezoid. Alternatively, the first and second opposed sides of the spring member apertures may be non-linear and substantially mirror images of each other, and may be configured to cause a substantially more rapid increase in an amount of the restoration force during the initial portion of a total of about 90 degrees of rotation from the horizontal opposed orientation to the vertical orientation of each of the two spring members.

An object of the present invention is to provide a clip mechanism comprising: a yoke member having a head portion at a head end, a base end and a trunk portion contiguous with the head portion and the base end; two spring members fabricated using material which is resilient but form retaining each comprising, a leg portion having two legs a crotch portion at a crotch end contiguous with the leg portion, which leg portion is contiguous with a foot portion at a foot end. The foot end is adapted to be interengageable with a head portion at a head end of the yoke member and is interengaged therewith. The crotch portion, leg portion and foot portion each has a predetermined cross section. The predetermined cross sections are each substantially similar to that of a tubular rod or a wire. Thus, this particular spring member, known as a wire spring member, is made from a rod or wire shaped object bent into a crotch portion, leg portion and foot portion. The wire spring member is characterized by being springingly bendable substantially through the crotch portion. The head portion of the yoke member has defined therein two pairs of foot holes each pair adapted to receive therein the foot portion of one of the at least two wire spring members and oriented to create an axis for the rotation for each of the at least two wire spring members. The head portion of the yoke member also has defined therein two wire spring member apertures. Each of the apertures has a periphery substantially that of a trapezoid defined by a short side a long side and opposed non-parallel but equal length first and second sides. The short and long side are parallel each to the other and parallel to the axis of rotation of the wire spring members. The short and the long side each being oriented on the head portion and spaced apart by an amount permitting the rotation of each of the at least two wire spring members. The short side is proximate the head end and the long side proximate the trunk portion of the yoke member. The first and second opposed and non-parallel sides provide a bearing surface against which an ankle portion of the foot portion of the wire spring member rests thereby creating restoration forces within each of the at least two wire spring members consequentially when each wire spring member is rotated from a normal and secure horizontal opposed orientation to a stressed and vertical orientation and also the resilience of the material. Finally there is an ornament member attached to the base end of the yoke member and geometrically configured to inhibit the ornament member from passing through a hole into which the two wire spring members and the yoke member may have been inserted.

These and further objects of the present invention will become apparent to those skilled in the art to which this invention pertains and after a study of the present disclosure of the invention.

BRIEF DESCRIPTION OF THE DRAWINGS

A single embodiment of the present invention is disclosed in the detailed description and in the drawings. The drawings include 12 figures to illustrate the embodiments, wherein like reference numerals in each drawing refer to like parts of the embodiment disclosed. Further, while only several embodiments are disclosed in the description and in the drawings, one of ordinary skill may easily further alter the size and the shape of the mechanism without changing the essential character of the invention disclosed herein. The drawings are briefly described as follows.

Figure 1:
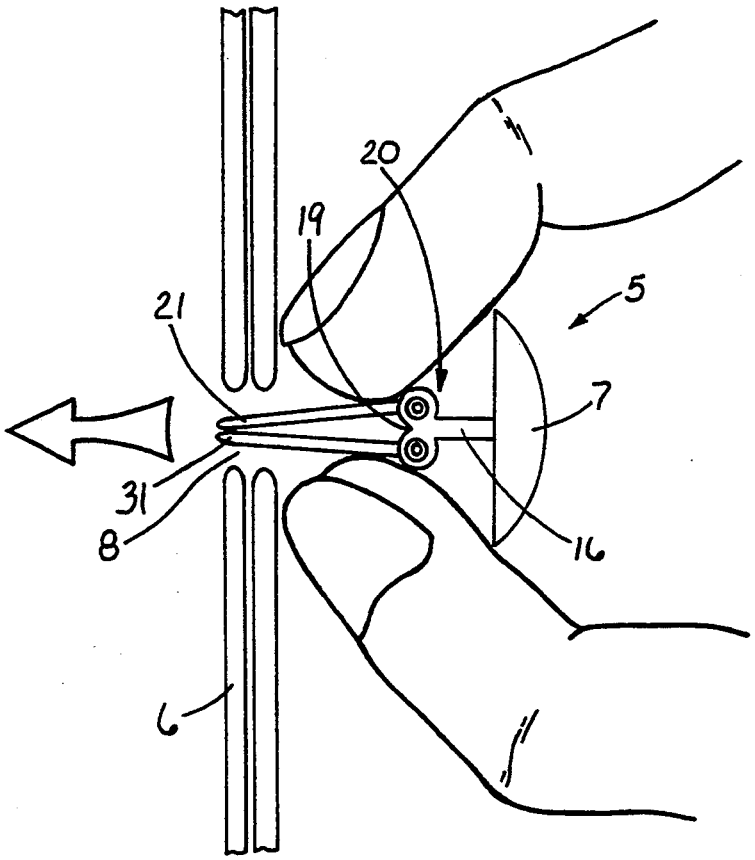
FIG. 1 is a side pictorial view of the clip/shirt-stud device, including a button member, illustrating a method of holding the clip mechanism and inserting the wire spring members of the clip mechanism into a button hole or cuff-link hole.
Figure 2:
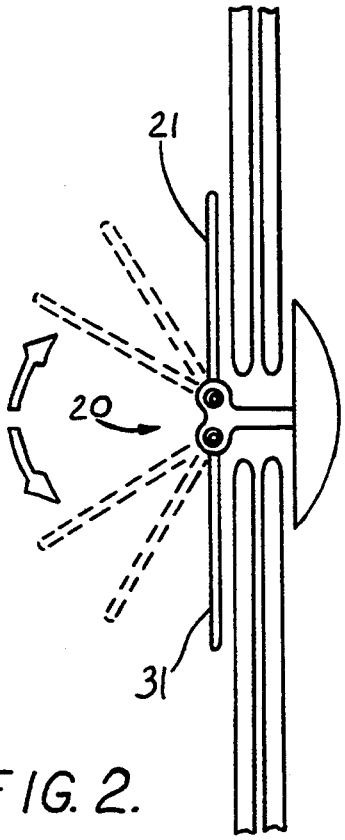
FIG. 2 is a side pictorial view of the clip/shirt-stud device which includes a button member and illustrating the device fully inserted into button hole or cuff-link hole and the dotted line motion of both wire spring members towards the open/secured position.
Figure 3:
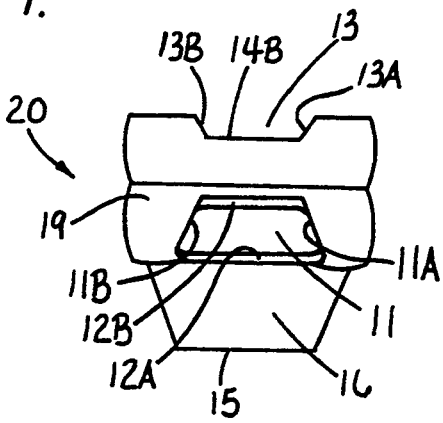
FIG. 3 is a top left side perspective view of the yoke member of the clip mechanism which yoke member is tipped slightly to illustrate the geometry of one of the substantially trapezoidal shaped spring apertures and illustrating the mirror-image positional relationship with the other spring aperture and the locations of the spring apertures on the head end of the yoke member.
Figure 4:
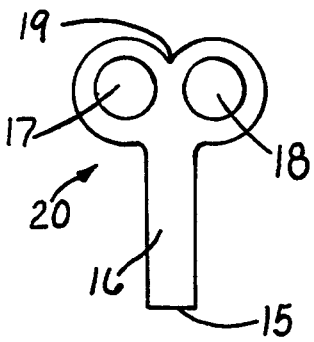
FIG. 4 is an end view of the yoke member of the clip mechanism illustrating the foot-holes.
Figure 5:
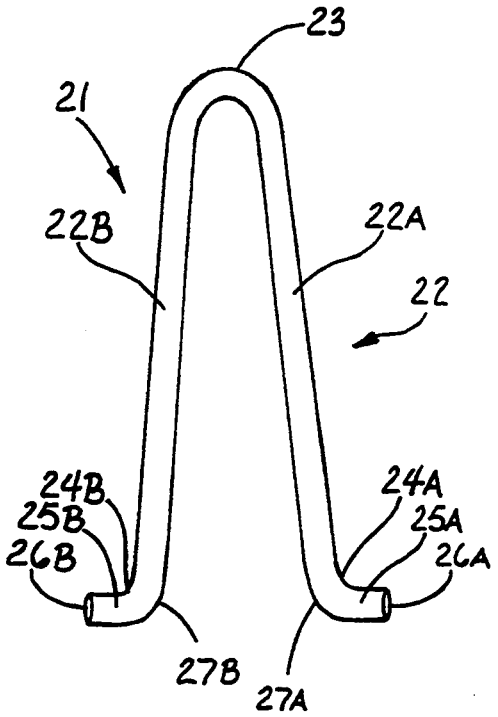
FIG. 5 is a top view of one of the wire spring members of the clip mechanism illustrating a foot portion at the foot end of one wire spring member.
Figure 8:
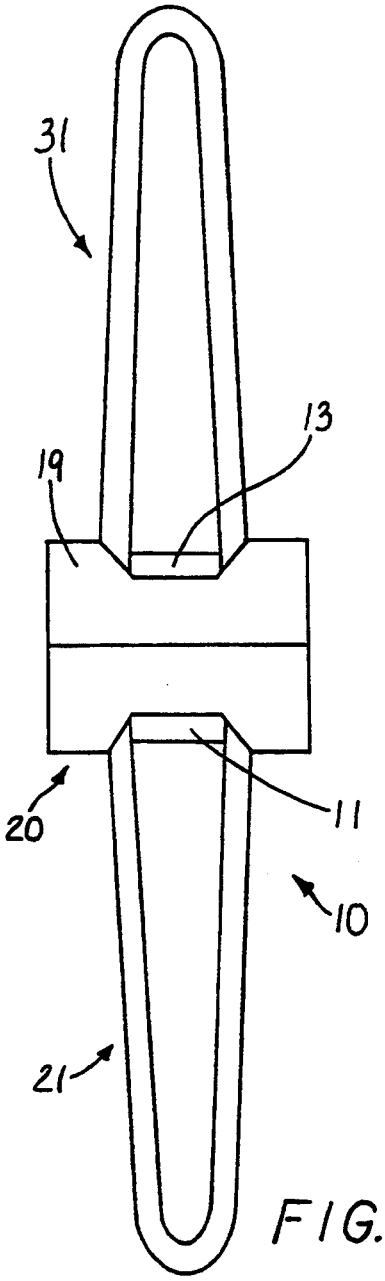
FIG. 8 is a top view of the assembled yoke and springs assembly of the clip mechanism illustrating the opposing nature of the two wire spring members when in the normally open/secured position.
Figure 6:
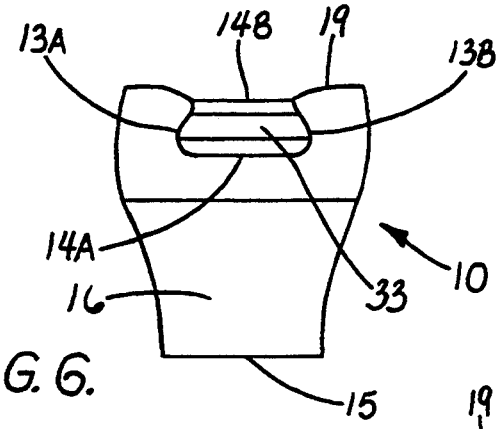
FIG. 6 is a side view of the assembled yoke and springs of the clip mechanism illustrating how the wire spring member stops in the substantially horizontal or the open/secured position.
Figure 7:
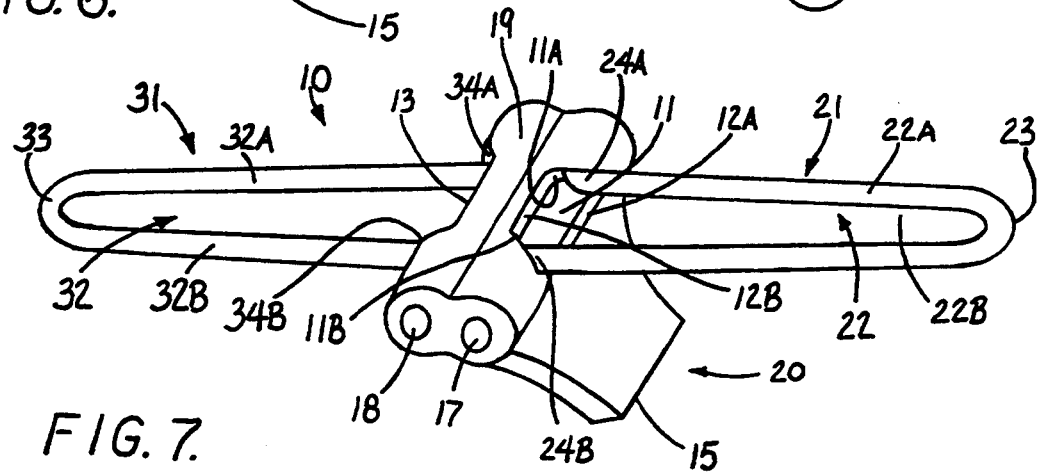
FIG. 7 is a top left side perspective view of the assembled yoke and wire springs of the clip mechanism illustrating how each of the wire spring members stop in the substantially horizontal or the open/secured position and illustrating the position of the foot-end of the wire spring member within the substantially trapezoidal shaped spring aperture.

In the detailed description, directional terms such as "upper", "lower", "front" or "front-facing", "rear" or "rear-facing" and the like, are used to relate the invention to the user of the mechanism while in a normal and erect position, Terms of this type are used for the convenience of the person of ordinary skill in the art, and are not to limit the scope of any patent issuing on the present invention, unless expressly included in the claims.

DESCRIPTION OF THE PREFERRED EMBODIMENTS

The following is a description of the preferred embodiment of the invention. In order to describe the invention most clearly and simply, the clip mechanism will be described as it may be used as a shirt stud or cuff-link and the spring members are made using material having a circular cross section, i.e., wire shaped material having spring characteristics. The preferred embodiment has two spring members and a trapezoidal shaped aperture into which the foot end of the spring members are inserted. Clearly, different materials, and different material geometries will cause the clip mechanism to have different performance characteristics. The configuration of the spring members may vary from that of a wing shape as shown in the several drawing figures. And it is obvious that the invention can be used for purposes other than displaying jewelry items on garments. However, so that the basic details of the invention can be more thoroughly set out, the detailed description will concentrate more on the particular embodiment of the invention which has two wire spring members and trapezoidally configured spring member apertures. Other uses of the mechanism disclosed herein fall within the scope of the invention disclosed and claimed herein including, but not limited to, the attaching together of a plurality of paper or fabric pieces, the attachment of the clip mechanism to a surface through holes not having convenient access to the backside thereof, i.e., the side opposing the side through which the wires or springs of the clip mechanism is inserted the attached clip mechanism being subsequently usable for the attachment thereto of tools, picture frames, clamps and the like.

Reference is now made to FIGS. 1–8 all of which depict the two wire spring member embodiment, the preferred embodiment of the clip mechanism 10 of the invention.

The main features of the clip mechanism 10 is the deformation of the spring members 21 and 31 as a consequence of the forcible rotation of each of the spring members 21 and 31 from a substantially horizontally opposed orientation with respect to each other to a relative and substantially parallel and vertical orientation. Spring members 21 and 31 are more precisely indicated as wire spring members. The rotation of the foot portions 25A and 25B within the foot-holes 17 and 18 of the yoke member 20 and the consequential squeezing together of the legs 22A, 22B (together referred to as 22) and 32A and 32B (together referred to as 32) of each spring member 21 and 31 because of the linear or non-linear geometry of the non-parallel sides 11A, 11B and 13A, 13B of the spring member apertures 11 and 13 respectively—the trapezoidal shape (or even a trapezium shaped aperture wherein the trapezium shaped aperture has a longer and a shorter side oriented such that the shorter side is closer to the head end of the yoke member) of the spring member aperture 11 and 13 located in the head portion 19 of the yoke member 20, creates a force within the spring members 21 and 31 and especially in the crotch portion 23 and 33 respectively of the spring members 21 and 31 which acts to restore the spring members 21 and 31 to their lower energy storing or normal substantially horizontally opposed orientation with respect to each other.

The degree of deformation is a function of the geometry of the preferred trapezoidal shaped apertures 11 and 13, i.e., the difference between the length of the short sides 12B and 14B and long parallel sides 12A and 14A respectively. The deformation is also a function of the cross section size of and the cross section geometry of the legs 22A and 22B of spring member 21 and 32A and 32B of spring member 31 and more particularly the ankle portions 24A, 24B and 34A and 34B of each of the spring members 21 and 31. As is apparent to one of ordinary skill, considerable mechanical advantage is available because of the moment created when pinching or squeezing the spring members 21 and 31 together and at the same time causing the legs portion 22A and 22B, and leg 32A and 32B to tend toward parallelism as the ankle portions 24A and 24B of member 21 and 34A and 34B of member 31 rotates and bears against the non-parallel sides 11A and 11B and 13A and 13B of the trapezoidal apertures 11 and 13 respectively and from the longer parallel sides 12A and 14A to the shorter parallel sides 12B and 14B of the trapezoidal apertures 11 and 13. The short parallel sides 12B and 14B of the apertures 11 and 13 also act to limit the rotation of the spring members 21 and 31 so that they do not go beyond a substantially vertical position or past a position of substantial parallelism one spring member 21 relative to the other spring member 31. The distance between the short and the long parallel sides is of an amount such that the spring members 21 and 31 rest (low energy state) in a substantially horizontal opposed orientation (the open/secured position) and are substantially parallel to each other and vertical when in the closed or the inserting position.

The more the deformation the greater will be the holding power of the device 5. That is, the forces tending to keep the spring members 21 and 31 horizontal and opposed is greater when the difference of the long 12A and 14A and short parallel sides 12B and 14B is increased. Obviously the forces are also a function of the material characteristics of the spring members 21 and 31. A simple "pinching" or "squeezing" action will result in the disengagement or the interengagement of the device 5 with the garment, i.e., a shirt cuff 6 for example.

In the interest of teaching the manner of manufacture of the clip mechanism 10, the ways for assembling the clip mechanism 10 are fully described. In so describing the manner of assembly, some of the advantages will become apparent to anyone of ordinary skill. After fastening the base 15 of the yoke 20 to an object 7 such as a jewelry item or button, each one of a pair of springs 21 and 31 is inserted into the spring apertures 11 and 13 of the yoke member 20. To accomplish the assembly of the spring members 21 and 31, one of the spring's feet 25A is first inserted. The length from the heel 27A to the toe 26A must be less than the length of the long parallel side 14A of the spring member aperture 11 so that the foot portion 25A can be inserted and then placed into the foot-hole 17 of the yoke member 20. Each leg portion 22 and 32 (comprised of leg 22A and 22B of spring member 21 and leg 32A and 32B of spring member 31) of the spring member 21 and 31 is then squeezed together and the spring's other foot 25B is inserted into the spring member aperture 11 and subsequently inserted into the other foot-hole 18. The other spring 31 is inserted similarly into the opposing aperture 13 on the other side of the yoke 20.

Wires/springs must be of spring hard temper either through work hardening of the wire or by using age hardenable alloys for the wire.

The short parallel sides 12B and 14B of each of the apertures 11 and 13 act as stops which are necessary at the top and at the bottom in order to assure that the spring members 21 and 31 do not over extend or by-pass positions that would interfere with their insertion or their securing the shirt/stud device 5 within the button hole 8.

The feet 25A, 25B and 35A, 35B lengths are determined by the length of the spring member aperture 11 or 13 across the long parallel side 14A or 12A minus one diameter of the spring's wire.

The distance between the two heels 27A and 27B of a single spring member 21 is greater than the distance across the long side 12A of the aperture 11. The distance across the top, the short parallel side 12B of the aperture 11 must be greater than or equal to the diameter of both of the wires of the legs 22 of the wire spring members 21 and 31.

The distance across the long parallel side 12A and 14A of the aperture 11 and 13 must be greater than or equal to the diameter of one of the spring's leg 22A wire plus the length of one of the spring's feet 25A from the extreme end of a heel 27A to the extreme end of a toe 26A.

The sides 11A, 11B and 13A, 13B of the apertures 11 and 13 must always be non-parallel and preferably linear and of equal length.

Trunk portion 16 of the yoke member 20 must always be sufficiently long to permit the clip mechanism 10 to go completely through the button hole 8 of the garment 6 and consequently the jewelry object 7 is maintained in proper position. It is preferable that yoke member 20 have a substantially rectangular cross-sectioned trunk portion 16. The advantage gained is that the precise alignment of an ornament or object 7 may be maintained especially where object 7 may be a monogram where a top and bottom of a letter needs to be properly positioned in order to be readable.

The base 15 of yoke member 20 should be configured to facilitate soldering or otherwise attaching jewelry object 7 to the clip mechanism 10. The crotch 23 and 33 of each of spring member 21 and 31 should cause legs 22 and 32 of springs 21 and 31 to be of equal length for ease of movement of the springs 21 and 31 between the insertion position and the secured position. Springs 21 and 31 are assembled into head portion 19 yoke member 20 after yoke 20 has been soldered to ornament 7. This feature of being able to do the assembly of springs 21 and 31 following the soldering of ornament 7 to yoke 20 is very important. Metals used in jewelry manufacture (gold, silver, brass) start to anneal at 900° F., approximately 200° F. to 400° F. below the temperature necessary for hard solderting (brazing). This feature is a substantial improvement over the present type of stud-clip mechanism whic would fail to function if exposed to such temperatures.

Figure 9:
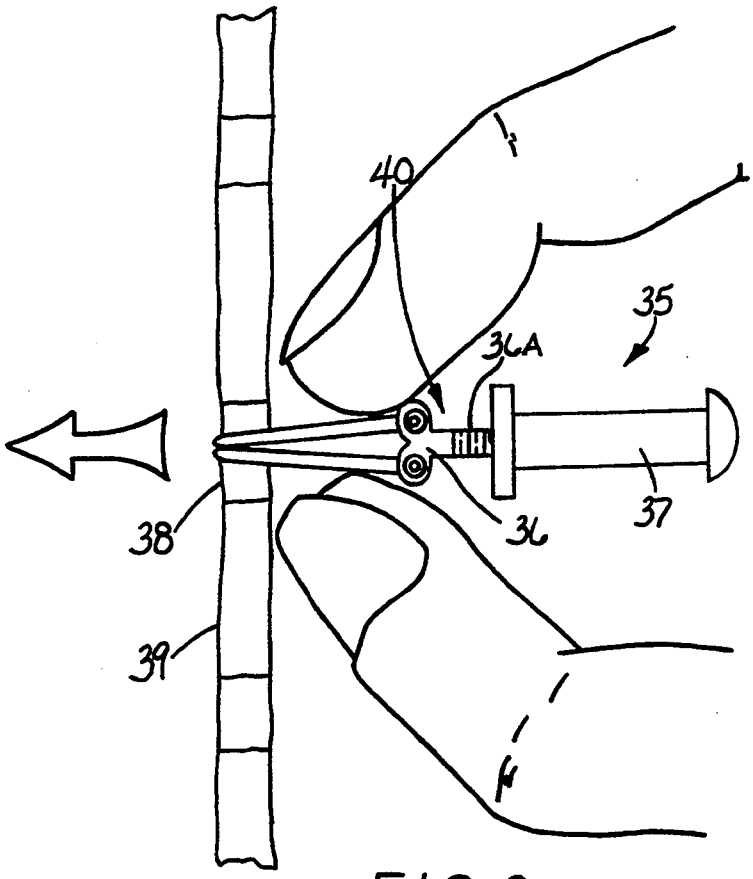
FIG. 9 is a side view of illustrating the clip mechanism used with a "peg" member which may then be assembled onto a peg-board.

FIG. 9 illustrates the use of a variation of clip mechanism 10. The clip mechanism of the peg device 35 has a peg member 37, a yoke member 40 having threads 36A thereon. When device 35 is inserted into holes 38 in board 39, peg member 37 may then be tightened by screwing onto threads 36A. When the device 35 is to be removed from the hole 38, a pull in a direction perpendicular to the surface of the board, i.e., parallel to the axis of the hole 38 will cause the spring members to move to the inserting position.

Figure 10:
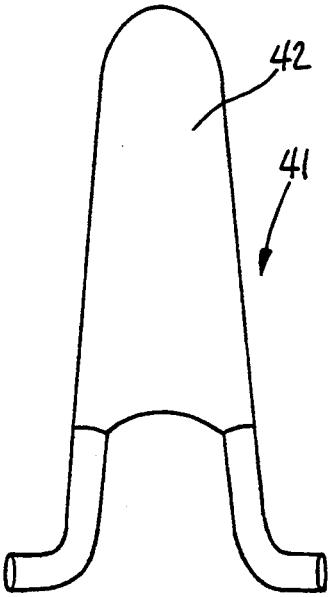
FIG. 10 is a top view of one of the ribbon spring members of the clip mechanism illustrating a foot portion at the foot end of one ribbon spring member.

FIG. 10 illustrates a variation of the spring member 21 and 31. The ribbon spring member 41 provides for possible greater deformation forces stored within at least a pair of ribbon spring members similar to ribbon spring member 41. The use of the ribbon portion 42 causes an increase in the amount of energy needed to squeeze the legs of the member together and consequently, the forces exerted to cause the spring members to tend to the lower energy orientation will be larger.

Figure 12:
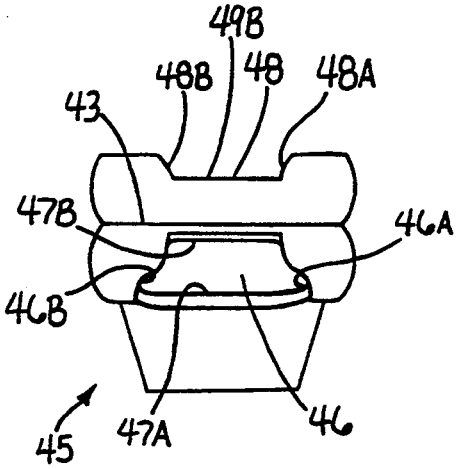
FIG. 12 is a view of one of the spring member apertures wherein the non-parallel sides are also non-linear.

FIG. 12 illustrates a yoke member 45 which is similar to yoke member 20 except for the variation in the spring member apertures 46 and 48. These two apertures 46 and 48 each have a long and a short side 47A, 47B and 49A, 49B which act to "stop" the rotational excursion of spring members which may be inserted within the apertures 46 and 48. The non-parallel sides 46A, 46B and 48A, 48B are in this embodiment non-linear and non-parallel. It is apparent that the advantage is that more force is need to start the spring members rotating from the horizontal toward the vertical orientations and less force is needed as the spring members approach the vertical orientation. The forces tending to maintain the springs in the horizontal orientation will be larger when a yoke member such as 45 is used.

Figure 11:
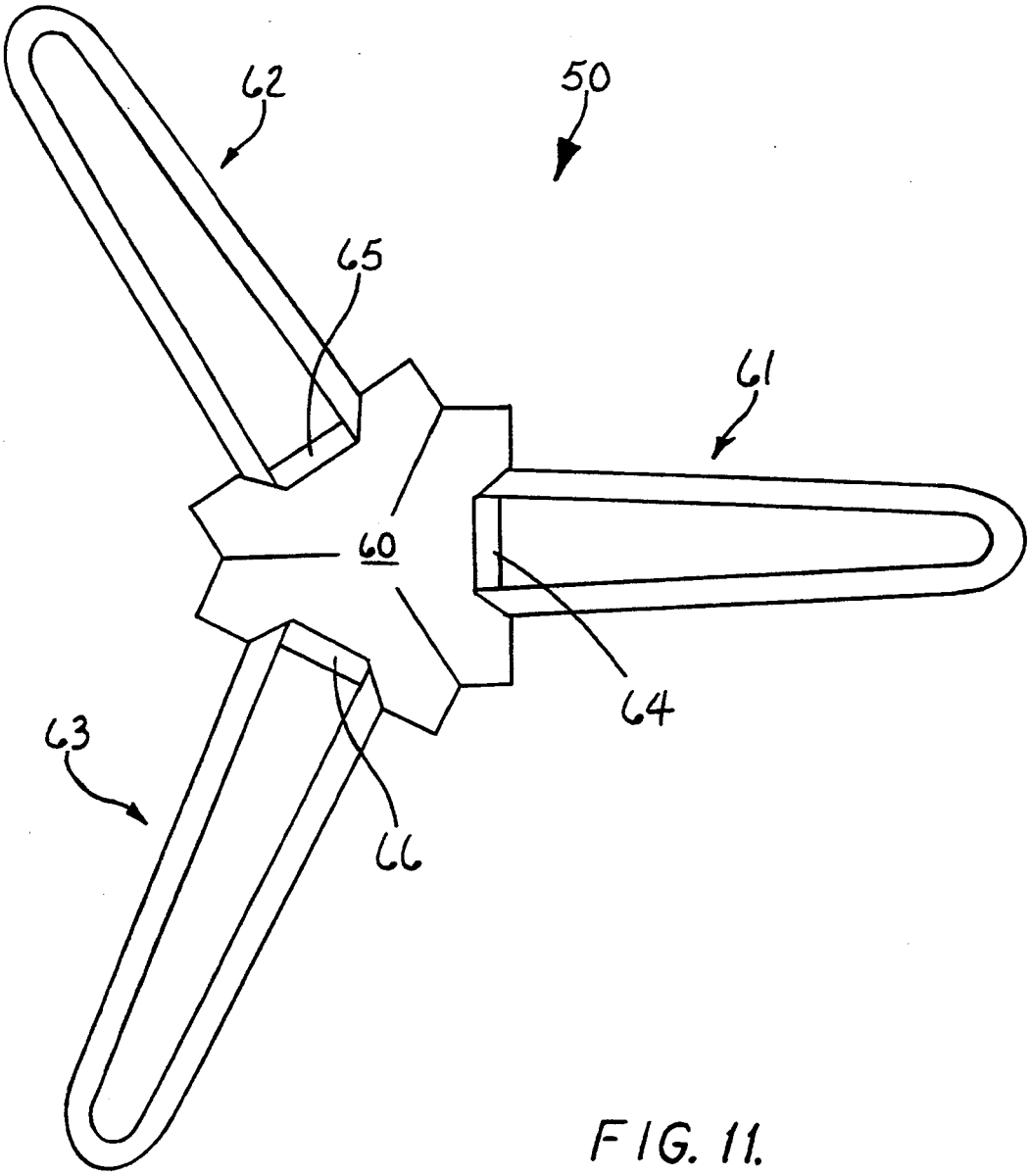
FIG. 11 is a top view of the assembled yoke and springs assembly of the clip mechanism illustrating the opposing nature of three wire spring members when in the normally open/secured position.

FIG. 11 illustrates a clip mechanism 50 having three spring members 51, 52 and 53 each one similar to spring members 21 and 31 or similar to spring members 41. The yoke member 60 permits the relative orientation of the three spring members and the apertures 54, 55 and 56 each have similar characteristics to the apertures 11 and 13 previously described. The obvious advantage of the mechanism 50 is the increase in the holding power of the clip mechanism over the mechanism 10 for similar geometries and materials for the spring members and similar geometries for the apertures.

Other uses of the mechanism disclosed herein fall within the scope of the invention disclosed and claimed herein including, but not limited to, the attaching together of a plurality of paper or fabric pieces, the attachment of the clip mechanism to a surface through holes not having convenient access to the backside thereof, i.e., the side opposing the side through which the wires or springs of the clip mechanism is inserted the attached clip mechanism being subsequently usable for the attachment thereto of tools, picture frames, clamps and the like.

It is thought that the present invention, the method and the clip/shirt-stud device 5 and more particularly the clip mechanism 10 for use with the device as disclosed herein and many of its attendant advantages is understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A clip mechanism comprising:

A yoke member having a head portion at a head end, a base end and a trunk portion contiguous with said head portion and said base end;

at least two spring members fabricated using material which is resilient but form retaining, each comprising, a crotch portion at a crotch end contiguous with at least a leg portion, said leg portion contiguous with a foot portion having a foot end, and said foot end adapted to be interengageable with said head portion and interengaged therewith;

each said crotch portion, said leg portion and said foot portion having a predetermined cross section;

interengaging means comprising said head portion having at least a set of foot holes for each said spring member, each said set of foot holes adapted to receive therein said foot end of a said spring member and oriented to create an axis for said rotation for said spring member; and means permitting rotation, upon pinching of each said spring member, comprising said head portion of said yoke member having therein at least two spring member apertures, each said aperture having a periphery defined by a short side a long side and a first and second opposed sides, said short and said long side being parallel each to the other and parallel to said axis of rotation of said spring members said short and said long side being oriented on said head portion and spaced apart by an amount permitting said rotation of each said spring member said short side proximate said head end and said long side proximate said trunk portion of said yoke member, said first and second opposed and non-parallel sides providing bearing surfaces against which ankle portions of said foot portion of said spring member rests thereby creating restoration forces within each of said spring members when each said spring member is rotated from a position wherein said ankle portions rest against said long side, to a position wherein said ankle portions rest against said short side and said spring member is stressed.

2. The clip mechanism according to claim 1 wherein said periphery of each of said at least two spring member apertures being substantially that of a trapezoid.

3. The clip mechanism according to claim 1 wherein said first and second opposed sides are non-linear and are substantially mirror images of each other, and are configured to cause a substantially more rapid increase in the amount of said restoration force during the first half of rotation of said spring members.

4. The clip mechanism according to claim 1 further comprising an ornament member attached to said base end of said yoke member and geometrically configured to inhibit said ornament member from passing through a hole into which said spring members and said yoke member may have been inserted.

5. A clip mechanism comprising:

A yoke member having a head portion at a head end, a base end and a trunk .portion contiguous with said head portion and said base end;

at least two ribbon spring members fabricated using material which is resilient but form retaining, each comprising a crotch portion at a crotch end contiguous with at least a leg portion having at least two legs, and having a predetermined cross section substantially similar to a strip like member, said leg portion contiguous with a foot portion having a foot end, and said foot end adapted to be interengageable with said head portion and interengaged therewith;

each said crotch portion, said leg portion and said foot portion having a predetermined cross section;

interengaging means comprising said head portion having at least a set of foot holes for each said ribbon spring member, each said set of foot holes adapted to receive therein said foot end of a said ribbon spring member and oriented to create an axis for said rotation for said ribbon spring member;

said ribbon spring member characterized by being springingly bendable through said leg portion along a direction from said foot end toward said crotch end, said forces created consequently by said rotating of each said ribbon spring members and said resilience of said material; and means permitting rotation, upon pinching of each said ribbon spring member, comprising said head portion of said yoke member having therein at least two ribbon spring member apertures, each said aperture having a periphery defined by a short side a long side and a first and second opposed sides, said short and said long side being parallel each to the other and parallel to said axis of rotation of said ribbon spring members said short and said long side being oriented on said head portion and spaced apart by an amount permitting said rotation of each said ribbon spring member said short side proximate said head end and said long side proximate said trunk portion of said yoke member, said first and second opposed and non-parallel sides providing bearing surfaces against which ankle portions of said foot portion of said ribbon spring member rests thereby creating restoration forces within each of said ribbon spring members when each said ribbon spring member is rotated from a position wherein said ankle portions rest against said long side, to a position wherein said ankle portions rest against said short side and said ribbon spring member is stressed.

6. The clip mechanism according to claim 5 wherein said periphery of each of said at least two ribbon spring member apertures being substantially that of a trapezoid.

7. The clip mechanism according to claim 5 further comprising an ornament member attached to said base end of said yoke member and geometrically configured to inhibit said ornament member from passing through a hole into which said ribbon spring members and said yoke member may have been inserted.

8. A clip mechanism comprising:

A yoke member having a head portion at a head end, a base end and a trunk portion contiguous with said head portion and said base end;

at least two wire spring members fabricated using material which is resilient but form retaining, each comprising, a crotch portion at a crotch end contiguous with a leg portion having two legs, and having a cross section substantially similar to that of two spaced substantially parallel wires, said leg portion contiguous with a foot portion having a foot end, and said foot end adapted to be interengageable with said head portion and interengaged therewith;

each said crotch portion, said leg portion and said foot portion having a predetermined cross section;

interengaging means comprising said head portion having at least a set of foot holes for each said wire spring member, each said set of foot holes adapted to receive therein said foot end of a said wire spring member and oriented to create an axis for said rotation for said wire spring member;

said wire spring member characterized by being springingly bendable substantially through said crotch portion, said forces creating consequently by said rotating of each of said wire spring members and said resilience of said material; and means permitting rotation, upon pinching of each said wire spring member, comprising said head portion of said yoke member having therein at least two wire spring member apertures, each said aperture having a periphery defined by a short side a long side and a first and second opposed sides, said short and said long side being parallel each to the other and parallel to said axis of rotation of said wire spring members said short and said long side being oriented on said head portion and spaced apart by an amount permitting said rotation of each said wire spring member said short side proximate said head end and said long side proximate said trunk portion of said yoke member, said first and second opposed and non-parallel sides providing bearing surfaces against which ankle portions of said foot portion of said wire spring member rests thereby creating restoration forces within each of said wire spring members when each said wire spring member is rotated from a position wherein said ankle portions rest against said long side, to a position wherein said ankle portions rest against said short side and said wire spring member is stressed.

9. The clip mechanism according to claim 8 wherein said periphery of each of said at least two wire spring member apertures being substantially that of a trapezoid.

10. The clip mechanism according to claim 8 further comprising an ornament member attached to said base end of said yoke member and geometrically configured to inhibit said ornament member from passing through a hole into which said wire spring members and said yoke member may have been inserted.

11. A clip mechanism comprising:

A yoke member having a head portion at a head end, a base end and a trunk portion contiguous with said head portion and said base and;

two wire spring members fabricated using material which is resilient but form retaining, each comprising, a leg portion having two legs a crotch portion at a crotch end contiguous with said leg portion, each leg portion is contiguous with a foot portion at a foot end, said foot end adapted to be interengageable with a head portion at a head end of said yoke member and interengaged therewith, said crotch portion, said leg portion and said foot portion each having a predetermined cross section, said predetermined cross sections each substantially similar to a wire where each said wire spring member is characterized by being springingly bendable substantially through said crotch portion, said head portion of said yoke member having defined therein two pairs of foot holes each pair adapted to receive therein said foot portions of each of said at least two wire spring members and oriented to create an axis for said rotation for each said at least two wire spring members;

said head portion of said yoke member having defined therein two wire spring member apertures, each said apertures having a periphery substantially that of a trapezoid defined by a short side a long side and opposed non-parallel but equal length first and second sides, said short and said long side being parallel each of the other and parallel to said axis of rotation of said wire spring members said short and said long side being oriented on said head portion and spaced apart by an amount permitting said rotation of each said at least two wire spring members said short side proximate said head end and said long side proximate said trunk portion of said yoke member, said first and second opposed and non-parallel sides providing a bearing surface against which an ankle portion of said foot portion of said wire spring member rests thereby creating restoration forces within each of said at two wire spring members consequentially when each said wire spring member is rotated from a normal and secure horizontal opposed orientation to a stressed and vertical orientation and said resilience of said material; and an ornament member attached to said base end of said yoke member and geometrically configured to inhibit said ornament member from passing through a hole into which said two wire spring members and said yoke member may have been inserted.

* * * * *